US008774651B2

(12) United States Patent
Miyoshi et al.

(10) Patent No.: US 8,774,651 B2
(45) Date of Patent: Jul. 8, 2014

(54) IMAGE FORMING APPARATUS

(75) Inventors: Ayaka Miyoshi, Kanagawa (JP); Hirofumi Goto, Kanagawa (JP); Yoshihisa Nakao, Kanagawa (JP); Akihiro Ouchi, Kanagawa (JP); Hiroaki Yagi, Kanagawa (JP); Kenji Suzuki, Kanagawa (JP); Hibiki Sasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 110 days.

(21) Appl. No.: 13/617,893

(22) Filed: Sep. 14, 2012

(65) Prior Publication Data

US 2013/0195481 A1 Aug. 1, 2013

(30) Foreign Application Priority Data

Jan. 26, 2012 (JP) ..... 2012-014121

(51) Int. Cl.
*G03G 15/00* (2006.01)

(52) U.S. Cl.
USPC ..... 399/38; 399/82; 359/291

(58) Field of Classification Search
USPC ..... 399/38, 39, 82
See application file for complete search history.

(56) References Cited

U.S. PATENT DOCUMENTS

2006/0216047 A1* 9/2006 Yamamoto et al. ..... 399/45
2008/0193180 A1* 8/2008 Shim et al. ..... 399/395

FOREIGN PATENT DOCUMENTS

JP 2007-240720 A 9/2007

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

An image forming apparatus includes an image forming unit that forms an image to be formed on a recording medium. The image formed by the image forming unit has a size larger than a size of the recording medium that is transported, the image forming unit causing the image to adhere to the entire area of the recording medium. A width of the image in a direction substantially orthogonal to a transporting direction of the recording medium increases from a front end toward a rear end of the recording medium in the transporting direction of the recording medium.

8 Claims, 8 Drawing Sheets

FIG. 3

| | | DIMENSION OF RECORDING SHEET IN WIDTH DIRECTION IS 139.7 mm OR MORE | DIMENSION OF RECORDING SHEET IN WIDTH DIRECTION IS LESS THAN 139.7 mm |
|---|---|---|---|
| | REFERENCE VALUES / BASIS WEIGHT | FRONT END: Af1 = 0.7 mm<br>REAR END: Ar1 = 0.0025L + 0.7 mm | FRONT END: Af2 = 1.8 mm<br>REAR END: Ar2 = 0.0073L + 1.8 mm |
| SET VALUE | $W \leq 129$ g/m$^2$ | FRONT END: Afs = Af1 × 1.0<br>REAR END: Ars = Ar1 × 1.0 | FRONT END: Afs = Af2 × 1.0<br>REAR END: Ars = Ar2 × 1.0 |
| | $129 < W \leq 151$ g/m$^2$ | FRONT END: Afs = Af1 × 0.9<br>REAR END: Ars = Ar1 × 0.9 | FRONT END: Afs = Af2 × 0.9<br>REAR END: Ars = Ar2 × 0.9 |
| | $151 < W \leq 177$ g/m$^2$ | FRONT END: Afs = Af1 × 0.8<br>REAR END: Ars = Ar1 × 0.8 | FRONT END: Afs = Af2 × 0.8<br>REAR END: Ars = Ar2 × 0.8 |
| | $177 < W \leq 220$ g/m$^2$ | FRONT END: Afs = Af1 × 0.7<br>REAR END: Ars = Ar1 × 0.7 | FRONT END: Afs = Af2 × 0.7<br>REAR END: Ars = Ar2 × 0.7 |
| | $W > 220$ g/m$^2$ | FRONT END: Afs = Af1 × 0.6<br>REAR END: Ars = Ar1 × 0.6 | FRONT END: Afs = Af2 × 0.6<br>REAR END: Ars = Ar2 × 0.6 |

L = LENGTH OF RECORDING SHEET IN TRANSPORTING DIRECTION

IMAGE FORMING APPARATUS

CROSS-REFERENCE TO RELATED APPLICATIONS

This application is based on and claims priority under 35 USC 119 from Japanese Patent Application No. 2012-014121 filed Jan. 26, 2012.

BACKGROUND (i) Technical Field

The present invention relates to an image forming apparatus.

(ii) Related Art

Image forming apparatuses that form an image on a sheet-shaped recording medium that is transported often form a so-called bordered image having margins along the edges of the recording medium. However, with the development of color-image forming technology, image forming apparatuses that form, for example, images such as photographs have become popular and there has been a demand to form a so-called borderless image in which an image is formed over the entire area of the recording medium.

SUMMARY

According to an aspect of the invention, there is provided an image forming apparatus including an image forming unit that forms an image to be formed on a recording medium. The image formed by the image forming unit has a size larger than a size of the recording medium that is transported, the image forming unit causing the image to adhere to the entire area of the recording medium. A width of the image in a direction substantially orthogonal to a transporting direction of the recording medium increases from a front end toward a rear end of the recording medium in the transporting direction of the recording medium.

BRIEF DESCRIPTION OF THE DRAWINGS

An exemplary embodiment of the present invention will be described in detail based on the following figures, wherein:

FIG. 3 is a table showing protruding widths of portions of the toner-image forming area that are outside the reference position of the recording sheet that is transported;

DETAILED DESCRIPTION

An exemplary embodiment of the present invention will be described with reference to the drawings.

Figure 1:
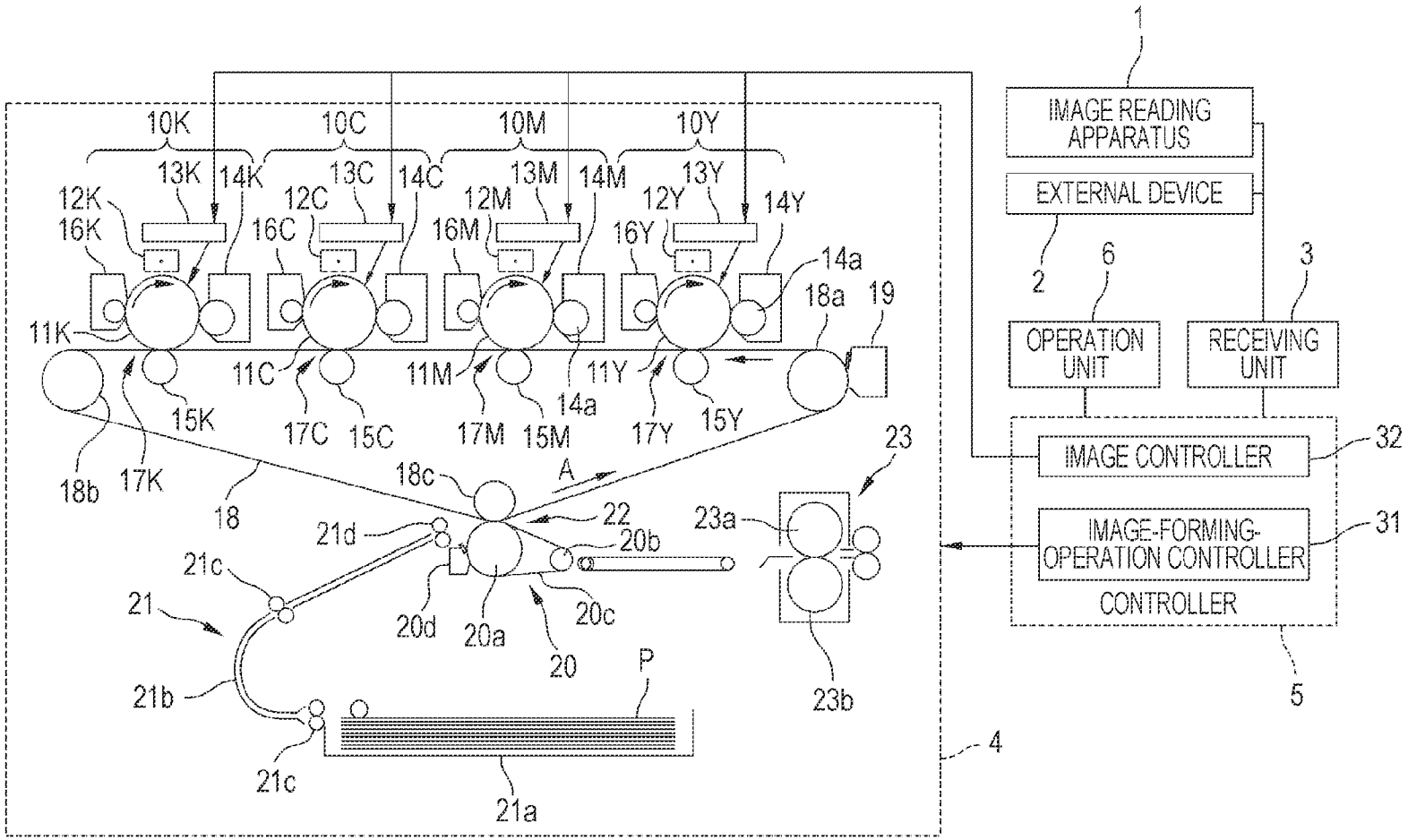
FIG. 1 is a schematic diagram illustrating an image forming apparatus according to an exemplary embodiment of the present invention.

FIG. 1 is a schematic diagram illustrating an image forming apparatus according to the exemplary embodiment of the present invention.

The image forming apparatus includes a receiving unit 3, an image forming section 4, a controller 5, and an operation unit 6. The receiving unit 3 is connected to an image reading apparatus 1 and an external device 2, such as a personal computer, by a communication unit and receives an image signal and image information. The image forming section 4 forms a toner image on a recording sheet, which is a recording medium, on the basis of the image signal and image information received by the receiving unit 3. The controller 5 controls the operation of the image forming section 4. The operation unit 6 allows an operator to input information for controlling the image forming section 4.

The image forming section 4 includes electrophotographic image forming units 10Y, 10M, 10C, and 10K that form color images by using toners of four colors, which are yellow (Y), magenta (M), cyan (C), and black (K), respectively, and an intermediate transfer belt 18 that face the image forming units 10Y, 10M, 10C, and 10K. The intermediate transfer belt 18 is arranged so as to face each of the image forming units 10, and the peripheral surface of the intermediate transfer belt 18 is rotatable. A second transfer device 20 is arranged so as to face the intermediate transfer belt 18 at a position downstream of the positions where the image forming units 10Y, 10M, 10C, and 10K face the intermediate transfer belt 18 in the rotating direction of the intermediate transfer belt 18. The second transfer device 20 performs a second transfer process of the toner image.

The image forming section 4 also includes a sheet feeding unit 21 that feeds recording sheets one at a time to a second transfer position 22 at which the second transfer device 20 faces the intermediate transfer belt 18.

A fixing device 23 is disposed downstream of the second transfer position 22 along a transport path of the recording sheet. The fixing device 23 fixes the toner image to each recording sheet by applying heat and pressure. An output paper holder (not shown) that holds the recording sheets to which the toner images have been fixed in a stacked manner is disposed downstream of the fixing device 23.

Each of the image forming units 10 includes a photoconductor drum 11 on the surface of which an electrostatic latent image is formed and which functions as an image carrier. A charging device 12, a developing device 14, a first transfer roller 15, and a cleaning device 16 are arranged around the photoconductor drum 11. The charging device 12 charges the surface of the photoconductor drum 11. The developing device 14 forms a toner image by selectively transferring toner to the latent image formed on the photoconductor drum 11. The first transfer roller 15 performs a first transfer process in which the toner image on the photoconductor drum 11 is transferred onto the intermediate transfer belt 18. The cleaning device 16 removes the toner that remains on the photoconductor drum 11 after the first transfer process. Each photoconductor drum 11 is provided with an exposure device 13 that irradiates the photoconductor drum 11 in a charged state with image light based on an exposure signal. The exposure device 13 writes the electrostatic latent image on the photoconductor drum 11 by irradiating the photoconductor drum 11 with the image light based on the exposure signal at a position upstream of the position at which the developing device 14 faces the photoconductor drum 11 in the moving direction of the peripheral surface of the photoconductor drum 11.

The photoconductor drum 11 is formed by stacking an organic photoconductor layer on the peripheral surface of a cylindrical member made of a metal. The metal portion is electrically grounded. A bias voltage may be applied to the photoconductor drum 11.

The charging device 12 substantially uniformly charges the peripheral surface of the photoconductor drum 11, which serves as a member to be charged. The charging device 12 includes an electrode wire that is arranged so as to face the photoconductor drum 11 with a gap therebetween. Alternatively, a roll-shaped or blade-shaped charging device that is in contact with or not in contact with the photoconductor drum 11 may be used.

The exposure device 13 emits a laser beam that is turned on and off in accordance with the exposure signal, and scans the peripheral surface of the photoconductor drum 11 with the laser beam by using a polygonal mirror. As a result, the electrostatic latent image is formed. Alternatively, an array of light emitting elements that are arranged so as to face the photoconductor drum 11, for example, may be used.

In the case where a borderless image is formed, the area irradiated with the image light is set such that the dimension of the area in the width direction of the peripheral surface of the rotating photoconductor drum 11 that rotates is larger than the width of the recording sheet that is transported and the dimension of the area in the circumferential direction is larger than the length of the recording sheet in the transporting direction.

The developing device 14 uses two-component developer containing toner and magnetic carrier, and includes a developing roller 14*a* disposed at a position where the developing device 14 faces the photoconductor drum 11. A layer of the two-component developer is formed on the peripheral surface of the developing roller 14*a* that rotates, and the toner is transferred from the peripheral surface of the developing roller 14*a* to the photoconductor drum 11. Thus, the electrostatic latent image is formed.

The first transfer roller 15 is disposed so as to face the photoconductor drum 11 with the intermediate transfer belt 18 interposed therebetween. A transfer bias voltage is applied between the first transfer roller 15 and the photoconductor drum 11, so that the toner image on the photoconductor drum 11 is electrostatically transferred onto the intermediate transfer belt 18.

The cleaning device 16 includes a cleaning blade or a cleaning brush that is in contact with the peripheral surface of the photoconductor drum 11 and removes the toner that remains on the photoconductor drum 11 after the transfer process.

The intermediate transfer belt 18 is an endless belt formed of a film-shaped member, and is wrapped around a driving roller 18*a* that is rotated, an adjusting roller 18*b* that adjusts the position of the intermediate transfer belt 18 in the width direction, and an opposing roller 18*c*. The intermediate transfer belt 18 rotates in the direction shown by arrow A in FIG. 1.

An intermediate-transfer-body cleaning device 19 is arranged so as to face the driving roller 18*a* with the intermediate transfer belt 18 interposed therebetween. The intermediate-transfer-body cleaning device 19 removes the toner that remains on the intermediate transfer belt 18 after the second transfer process.

The second transfer device 20 is arranged so as to face the opposing roller 18*c* with the intermediate transfer belt 18 interposed therebetween, and includes a second transfer roller 20*a*, an auxiliary roller 20*b*, a second transfer belt 20*c* wrapped around the second transfer roller 20*a* and the auxiliary roller 20*b*, and a second transfer cleaning device 20*d* that removes the toner that adheres to the second transfer belt 20*c*.

The second transfer belt 20*c* is nipped between the opposing roller 18*c* and the second transfer roller 20*a* while being stacked together with the intermediate transfer belt 18. The second transfer belt 20*c* is rotated by the rotation of the intermediate transfer belt 18. When a recording sheet is transported to the position between the intermediate transfer belt 18 and the second transfer belt 20*c*, the intermediate transfer belt 18 and the second transfer belt 20*c* transport the recording sheet while nipping the recording sheet therebetween. A second transfer bias voltage is applied between the second transfer roller 20*a* and the opposing roller 18*c*, so that the toner image on the intermediate transfer belt 18 is transferred onto the recording sheet.

The fixing device 23 includes a heating roller 23*a* having a heat source therein and a pressing roller 23*b* that is pressed against the heating roller 23*a*. The fixing device 23 causes the recording sheet onto which the toner image has been transferred to be nipped between the heating roller 23*a* and the pressing roller 23*b*, and fixes the toner image to the recording sheet by applying heat and pressure.

The sheet feeding unit 21 includes a sheet container device 21*a* that contains the recording sheets in a stacked manner and a sheet transport path 21*b* that transports the recording sheets that are fed one at a time to the second transfer position 22. Transport rollers 21*c* and registration rollers 21*d* are arranged on the sheet transport path 21*b*. The transport rollers 21*c* transport each recording sheet. The registration rollers 21*d* transport the recording sheet to the second transfer position 22 in time with the movement of the toner image on the intermediate transfer belt 18.

A guide member 24 (see FIG. 7) that regulates the position of a side edge of the recording sheet that is transported is disposed upstream of the position at which the registration rollers 21*d* are provided. The recording sheet is transported to the registration rollers 21*d* along the guide member 24. In other words, the position of the recording sheet is regulated by so-called side registration. The registration rollers 21*d* transport the recording sheet to the second transfer position 22 after correcting skewing, which is the state in which the recording sheet is transported while being inclined with respect to the transporting direction.

The controller 5 includes an image-forming-operation controller 31 and an image controller 32. The image-forming-operation controller 31 controls the operation of the image forming section 4. The image controller 32 performs image processing on the basis of the image information input to the receiving unit 3 and generates an exposure signal to be used in the exposure process.

The image controller 32 generates the exposure signal, which corresponds to the image light that forms the image of each color, on the basis of the image signal and image information received from, for example, the external device 2 and operates the exposure device 13 of each color. The image controller 32 also sets an area of each photoconductor drum 11 to be exposed to light, and the set area of the photoconductor drum 11 is scanned with the laser beam.

The area of each photoconductor drum 11 that is scanned with the laser beam, that is, the area in which an image is formed, is set in accordance with, for example, the size of the recording sheet onto which the toner image is transferred. The image forming area is set differently depending on whether a so-called borderless image or a so-called bordered image is formed. In the case where a bordered image is formed, the image forming area is set to be smaller than the size of the recording sheet. In the case where a borderless image is formed, the image forming area is set to be larger than the size of the recording sheet.

Whether to form a bordered image or a borderless image may be determined on the basis of a signal input by the operator through the operation unit 6 or information included in a signal input from, for example, the external device 2.

Figure 2:
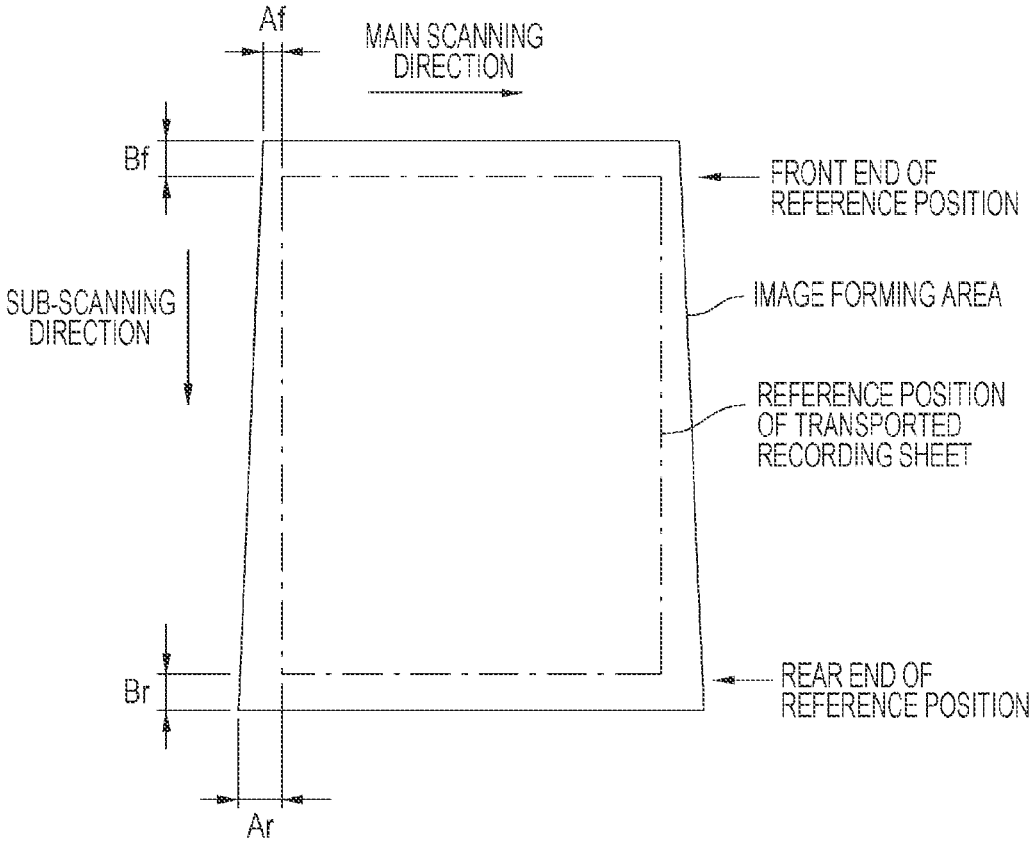
FIG. 2 illustrates a toner-image forming area that is set to be larger than the size of a recording sheet.

In the case where a borderless image is formed, as illustrated in FIG. 2, the area in which the image is formed on the photoconductor drum 11 is larger than the size of the recording sheet in both a sub-scanning direction at the exposure position, that is, the direction in which the image is transferred onto the recording sheet, and a main scanning direction at the exposure position, that is, the width direction of the transported recording sheet. Here, the dimension of the area in the width direction is small at the front end and increases toward the rear end in the direction in which the image is formed (sub-scanning direction). In other words, when the image is transferred onto the recording sheet, the width of the image is larger than the width of the recording sheet at a position corresponding to the front end of the transported recording sheet and is increased at the rear end of the transported recording sheet. Therefore, as illustrated in FIG. 2, a protruding width, which is the width of an area outside each side edge of the recording sheet at a reference position thereof when the image is transferred onto the recording sheet, linearly increases from the front end toward the rear end in the transporting direction. In other words, the protruding width Ar in the width direction at the rear end of the transported recording sheet is larger than the protruding width Af in the width direction at the front end of the transported recording sheet. A front protruding width Bf, which is the width of a portion of the image that is in front of the front edge of the recording sheet, and a rear protruding width Br, which is the width of a portion of the image behind the rear edge of the recording sheet, are constant in the width direction. The image forming area may be set such that the front and rear edges thereof are parallel to the front and rear edges of the reference position of the transported recording sheet.

The above-described protruding widths Af and Ar in the width direction of the recording sheet are changed in accordance with the basis weight and the dimension in the width direction of the recording sheet. More specifically, the protruding widths Af and Ar in the width direction for the case where the basis weight of the recording sheet is large are set to be smaller than those for the case where the basis weight of the recording sheet is small. In addition, the protruding widths Af and Ar in the width direction for the case where the size of the recording sheet is large are set to be smaller than those for the case where the size of the recording sheet is small. This is because the accuracy of the position in the width direction and the direction of the recording sheet differs depending on the size and basis weight of the recording sheet when the recording sheet is transported from the registration rollers 21*d*.

The protruding widths Bf and Br in front of and behind the transported recording sheet may either be changed in accordance with the size and basis weight of the recording sheet or maintained constant.

In the present exemplary embodiment, as shown in the table of FIG. 3, reference values Af1 and Ar1 or reference values Af2 and Ar2 are set as reference values of the protruding widths in the width direction depending on whether the dimension of the recording sheet in the width direction is 139.7 mm or more or less than 139.7 mm as follows. That is, when the dimension of the recording sheet in the width direction is 139.7 mm or more, the reference value Af1 of the protruding width at the front end is set to 0.7 mm and the reference value Ar1 of the protruding width at the rear end is set to 0.0025×L+0.7 mm. When the dimension of the recording sheet in the width direction is less than 139.7 mm, the reference value Af2 of the protruding width at the front end is set to 1.8 mm and the reference value Ar2 of the protruding width at the rear end is set to 0.0073×L+1.8 mm. Here, L (mm) is the length of the recording sheet in the transporting direction.

Then, set values Afs and Ars of the protruding widths are calculated on the basis of the above-described reference values, which are set in accordance with the dimension of the recording sheet, by changing the reference values in accordance with the basis weight w. For example, when the basis weight is 129 g/m$^2$ or less, the reference values are not changed. When the basis weight of the recording sheet is greater than 129 g/m$^2$ and 151 g/m$^2$ or less, the set values Afs and Ars of the protruding widths are set to 90% of the reference values. When the basis weight of the recording sheet is greater than 151 g/m$^2$ and 177 g/m$^2$ or less, the set values Afs and Ars of the protruding widths are set to 80% of the reference values. When the basis weight of the recording sheet is greater than 177 g/m$^2$ and 220 g/m$^2$ or less, the set values Afs and Ars of the protruding widths are set to 70% of the reference values. When the basis weight of the recording sheet is greater than 220 g/m$^2$, the set values Afs and Ars of the protruding widths are set to 60% of the reference values.

The above-described setting of the protruding widths in the width direction is an example, and may be changed in accordance with, for example, the recording-sheet-transporting function of the image forming apparatus that is used.

Figure 4:
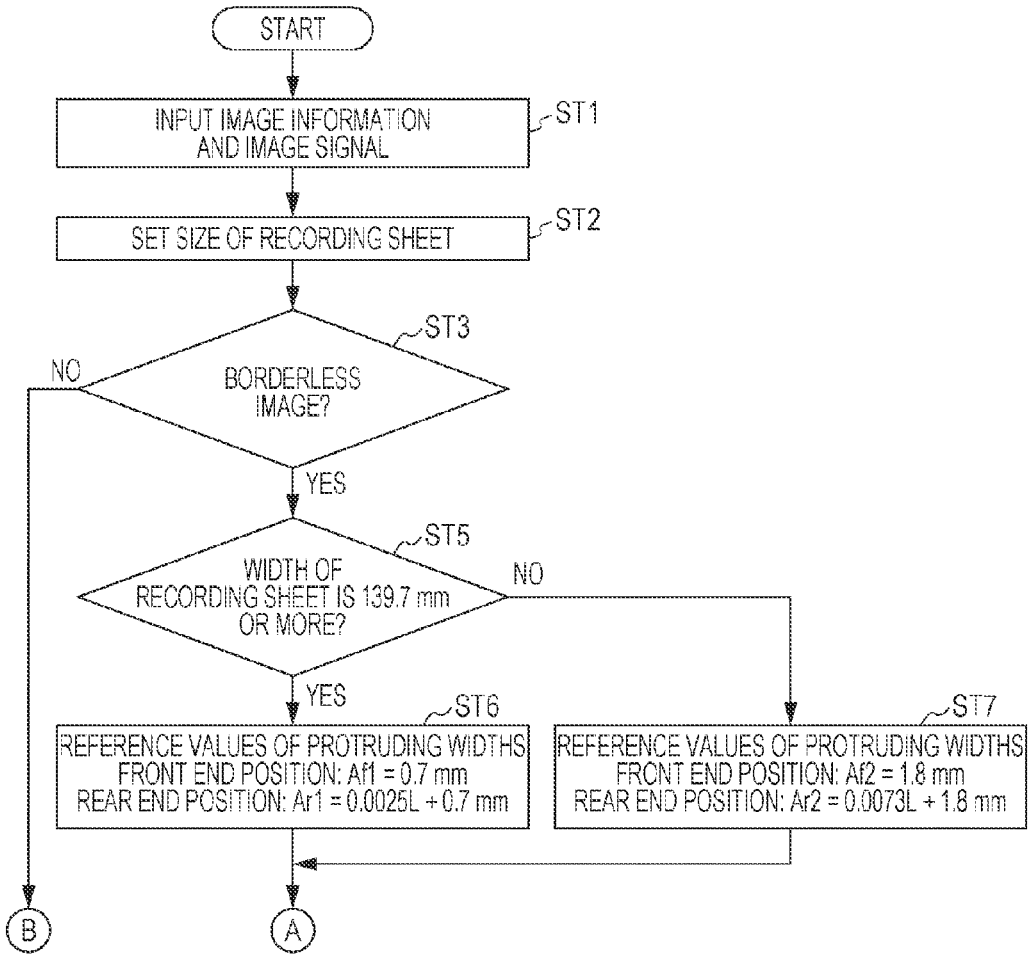
FIG. 4 is a flowchart of an operation of the image forming apparatus illustrated in FIG. 1.
Figure 5:
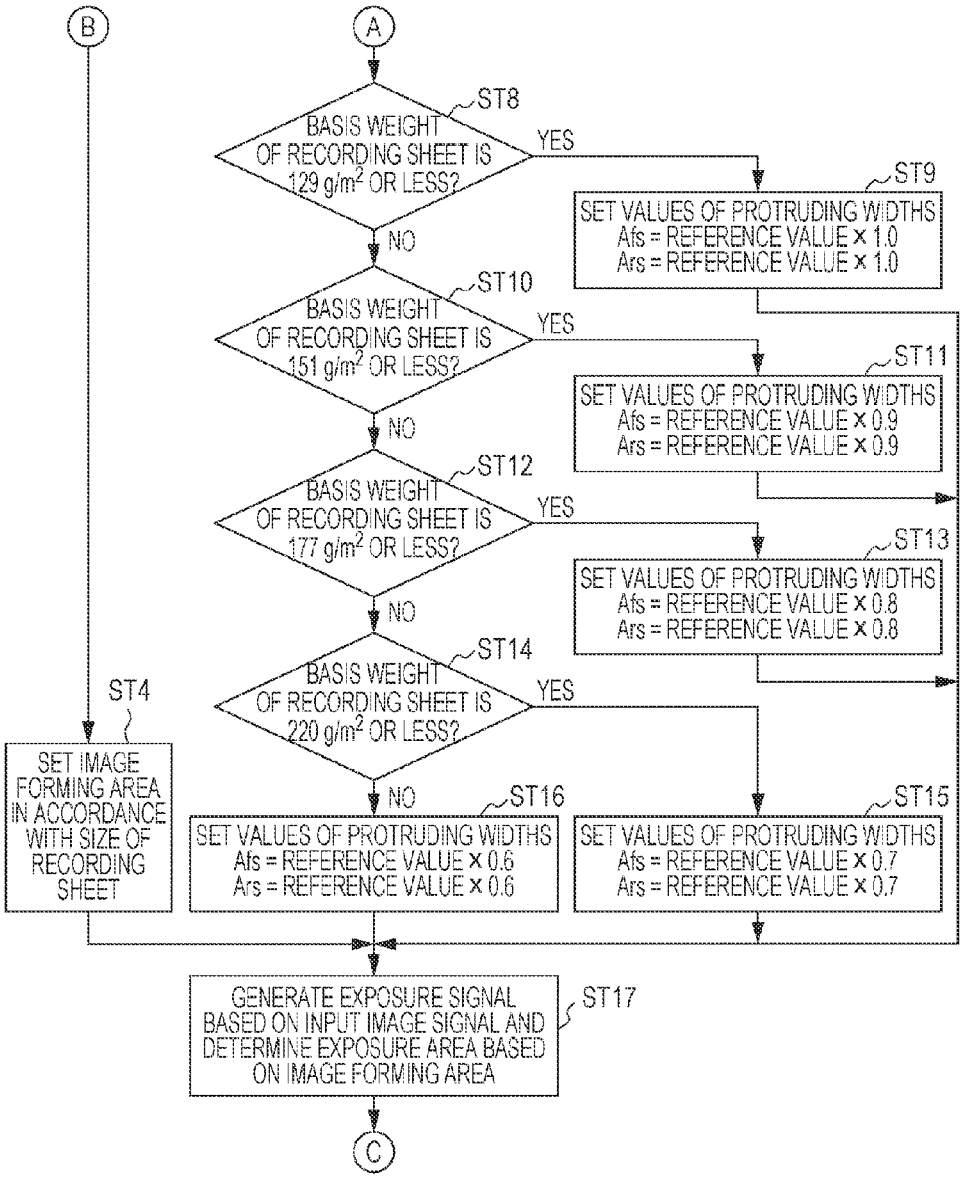
FIG. 5 is a flowchart of the operation of the image forming apparatus illustrated in FIG. 1.
Figure 6:
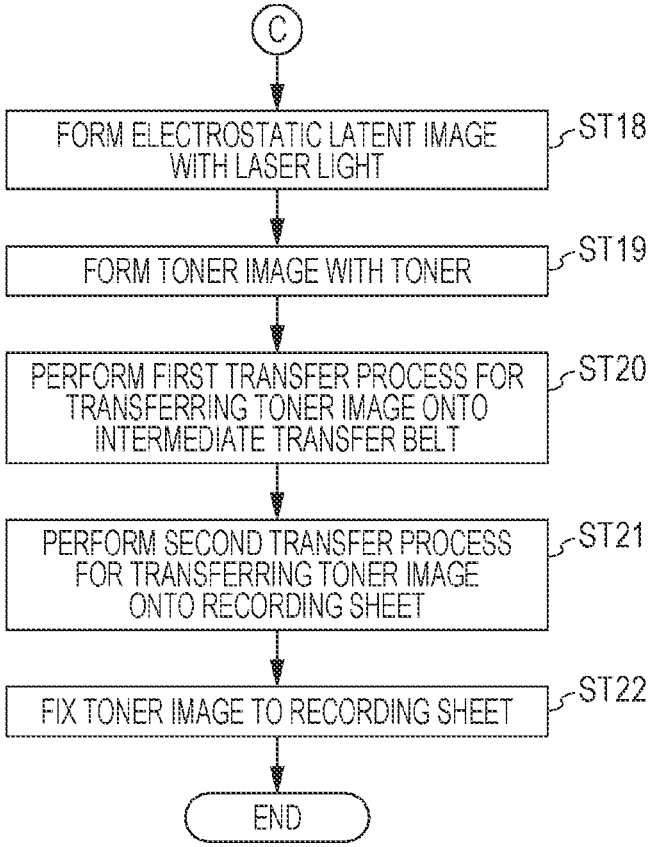
FIG. 6 is a flowchart of the operation of the image forming apparatus illustrated in FIG. 1.

An image forming operation performed by the image forming apparatus will now be described. First, an image signal is input from, for example, the image reading apparatus 1 or the external device 2 and image information is obtained from a signal input by the operation unit 6 operated by the operator or a signal from the external device 2 (ST1 in FIG. 4). The image information is, for example, the size and thickness of the recording sheet that is used and whether or not a borderless image is selected. Then, the size of the recording sheet that is used is set (ST2). Next, whether or not a borderless image is to be formed is selected (ST3). When a bordered image is to be formed, an image forming area that corresponds to the size of the recording sheet is set (ST4 in FIG. 5). When a borderless image is to be formed, it is determined whether or not the width of the recording sheet is 139.7 mm or more (ST5). Then, the reference values Af1 and Ar1 or the reference values Af2 and Ar2 of the protruding widths in the width direction of the transported recording sheet are set depending on whether the width of the recording sheet is 139.7 mm or more or less than 139.7 mm (ST6 and ST7). In other words, the reference values Af1 and Ar1 for when the width of the recording sheet is 139.7 mm or more or the reference values Af2 and Ar2 for when the width of the recording sheet is less than 139.7 mm are calculated from the equations in the table of FIG. 3. As illustrated in FIG. 5, when the basis weight w of the recording sheet that is used is greater than 129 g/m$^2$, the protruding widths are reduced from the reference values thereof in accordance with the basis weight (ST8 to ST16). Thus, the image forming area is set.

When the image forming area is set as described above, the exposure signal on the basis of which the image forming area is subjected to exposure is generated on the basis of the image signal (ST17). In the case of forming a borderless image, the width of the exposed area is larger at the rear end of the image than at the front end of the image. The input image signal generally corresponds to a rectangular original image. The shape of the image formed by the exposure signal and having the larger width at the rear end may be set by setting the ends of the rectangular original image in the width direction so as to correspond to the side edges of the rear end portion, which has the larger width, of the image formed by the exposure signal and setting pixels around the side edges of the front portion of the original image so as not to be subjected to the exposure. Alternatively, the shape may be set by setting the ends of the rectangular original image in the width direction so as to correspond to the side edges of the front end portion of the image formed by the exposure signal and supplying complementary pixels to the rear portion having the larger width, the complementary pixels being created on the basis of the periodicity of the pixels around the side edges of the original image.

Each exposure device 13 scans the corresponding photoconductor drum 11 with a laser beam on the basis of the exposure signal, so that a latent image based on a difference in electrostatic potential is formed (ST18). Subsequently, the developing device 14 transfers the toner to the exposed portions of the latent image, so that a toner image is formed (ST19). The toner image is formed by each of the four image forming units. Thus, yellow, magenta, cyan, and black toner images are formed, and are then transferred onto the intermediate transfer belt 18 in a superimposed manner at first transfer positions 17 at which the intermediate transfer belt 18 face the first transfer rollers 15 (ST20). The toner images are transported to the second transfer position 22 by the rotation of the intermediate transfer belt 18.

Figure 7:
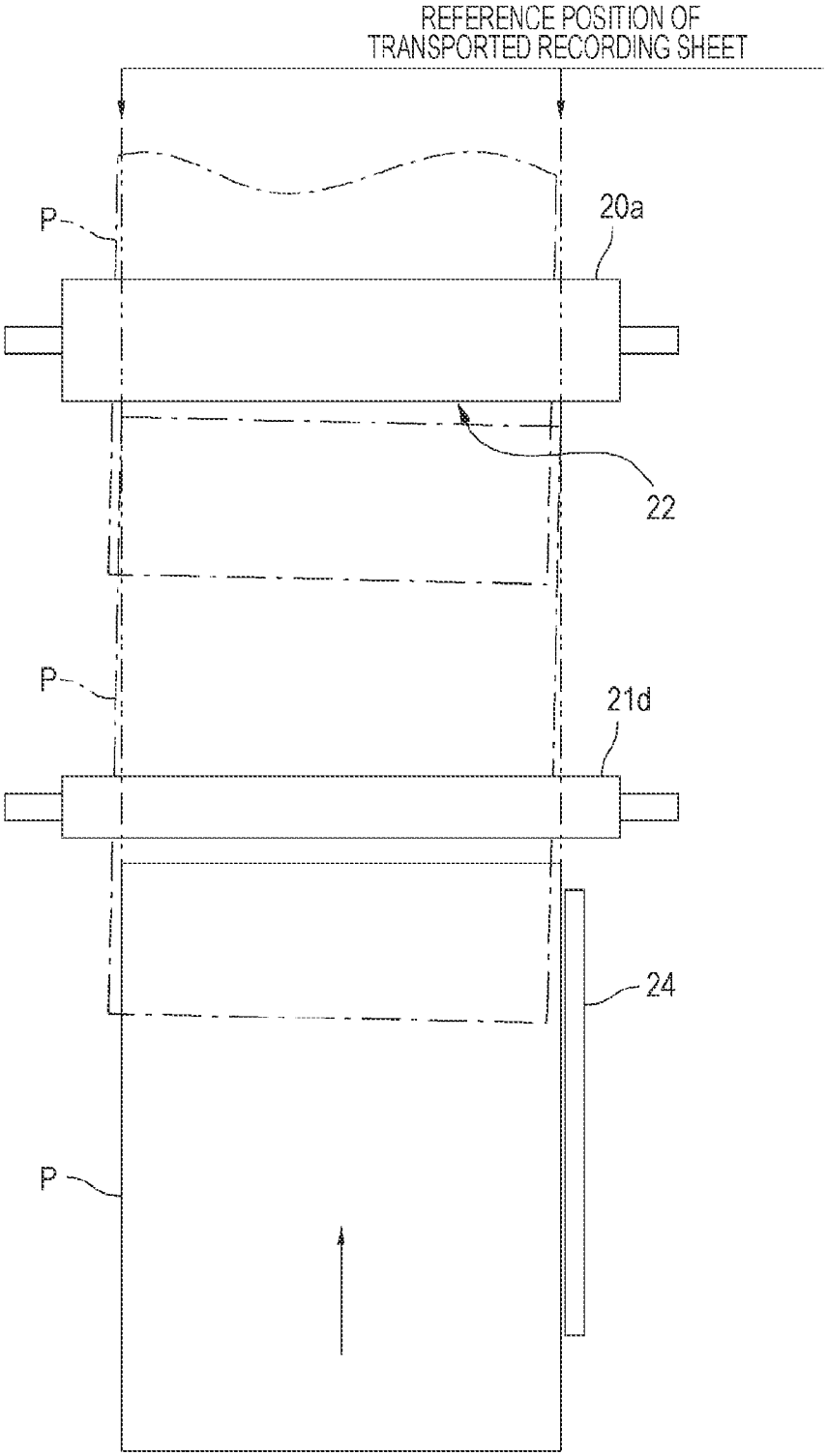
FIG. 7 illustrates the orientation of the recording sheet and the manner in which the recording sheet becomes displaced from the reference position while the recording sheet is being transported.

The recording sheets P are fed from the sheet container device 21*a* one at a time, and each recording sheet P is transported through the sheet transport path 21*b* to the registration rollers 21*d*. The position of the recording sheet P in the width direction is regulated by the guide member 24, as illustrated in FIG. 7, and the orientation of the recording sheet P is adjusted so that each side edge of the recording sheet P extends parallel to the transporting direction. Thus, so-called skewing is corrected. However, when the recording sheet P is transported to the second transfer position 22, there is a possibility that the recording sheet P will be displaced from the reference position at which the recording sheet P is expected to be positioned for transferring of the toner images. The displacement of the recording sheet P in the width direction includes an error caused when the position of the recording sheet P is regulated at the position where the registration rollers 21*d* are disposed and an error caused while the recording sheet P is being transported from the registration rollers 21*d* to the second transfer position 22. There is also a possibility that the side edges of the recording sheet P will be non-parallel to the transporting direction and the recording sheet P will be transported while being inclined with respect to the transporting direction. If the recording sheet P is inclined, the displacement of the recording sheet P from the reference position increases toward the rear end when the recording sheet P passes through the second transfer position 22. The displacement of the recording sheet P from the reference position decreases as the basis weight of the recording sheet P increases. In addition, the displacement increases as the width of the recording sheet P decreases.

The transportation of the recording sheet P in the inclined manner may occur owing to, for example, errors in diameters of the registration rollers 21*d* along the axial direction or errors in parallelism between the registration rollers 21*d* and the second transfer roller 20*a* when the recording sheet P is transported from the registration rollers 21*d* to the second transfer position 22. The skewing and displacement of the recording sheet P may also occur owing to, for example, a difference in the degree of moisture absorption or warping of the recording sheet P.

Figure 8:
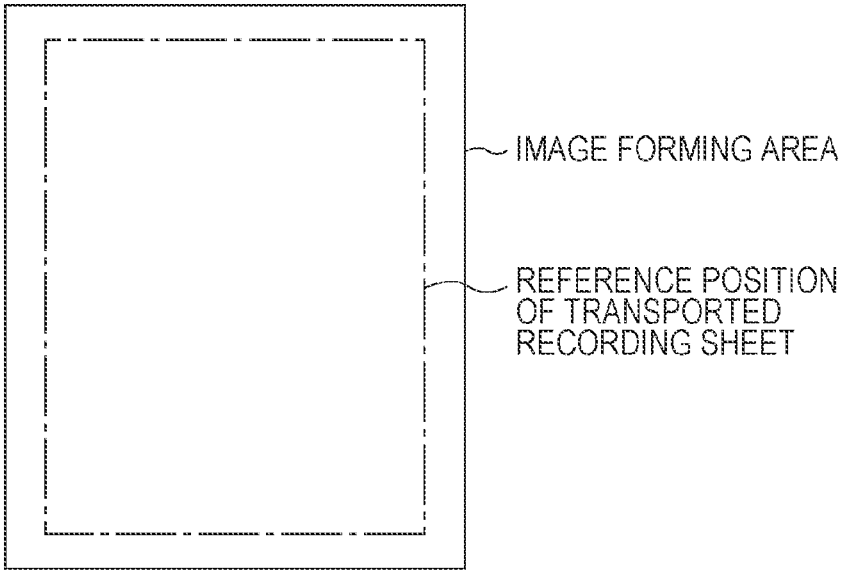
FIG. 8 RELATED ART
FIG. 8 illustrates an area in which a toner image is formed in an image forming apparatus according to the related art.

As a countermeasure against the above-described displacement of the recording sheet, when a borderless image is to be formed, each toner image is formed in the following manner. That is, as illustrated in FIG. 2, the width of the toner image is set so as to increase from the front end toward the rear end in the transporting direction, and the protruding width, which is the width of a portion of the toner image outside the area of the recording sheet, is set on the basis of the basis weight and the width of the recording sheet. Accordingly, when the recording sheet is transported to the second transfer position 22 and the toner images that are transported by the intermediate transfer belt 18 are transferred onto the recording sheet (ST21), an image may be formed on the recording sheet over the entire area thereof without leaving an area in which no image is formed. Compared to the case in which a rectangular image is formed so as to cover the largest expected displacement from the reference position of the recording sheet that has been transported to the second transfer position 22, as illustrated in FIG. 8, the protruding width Af in the width direction is reduced at the front end. As a result, the amount of toner that is used may be reduced. In addition, in the case where the basis weight of the recording sheet is large and the amount of displacement of the recording sheet is expected to be small, the protruding widths Af and Ar of the image forming area may be reduced and the amount of toner that is used may be reduced.

When the toner images are transferred onto the recording sheet, portions of the toner images outside the side edges and the front and rear edges of the recording sheet, that is, portions that protrude from the recording sheet, are transferred onto the second transfer belt 20*c* and collected by the second transfer cleaning device 20*d*.

The recording sheet onto which the toner images have been transferred as described above is transported to the fixing device 23, which fixes the toner images to the recording sheet by applying heat and pressure.

The present invention is not limited to the above-described exemplary embodiment, and various modifications are possible within the scope of the present invention.

For example, the above-described setting of the protruding widths is merely an example, and the protruding widths in the width direction may be set in accordance with the type of the image forming apparatus. Furthermore, the protruding widths may be changed on the basis of not only the size and basis weight of the recording sheet but also the type of the recording sheet.

In the present exemplary embodiment, it is assumed that the basis weight of the recording sheet is input by the operator or included in the signal transmitted from an external device. However, a sensor that detects the thickness of the recording sheet may be arranged in, for example, the sheet container device or the transport path and the protruding widths may be set on the basis of the detection value obtained by the sensor.

According to the above-described exemplary embodiment, an image is formed by causing the toner to adhere to an electrostatic latent image. However, the image forming apparatus may instead be an inkjet image forming apparatus. In this case, the area in which the ink is ejected is set to be larger than the size of the recording sheet to form an image over the entire area of the recording sheet. The image is formed by ejecting the ink on the basis of the image signal such that the width thereof linearly increases from when the front end of the recording sheet passes an ink ejection unit to when the rear end of the recording sheet passes the ink ejection unit.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image to be formed on a recording medium, wherein the image formed by the image forming unit has a size larger than a size of the recording medium that is transported, the image forming unit causing the image to adhere to the entire area of the recording medium, wherein a width of the image in a direction substantially orthogonal to a transporting direction of the recording medium increases from a front end toward a rear end of the recording medium in the transporting direction of the recording medium.

2. The image forming apparatus according to claim 1, wherein the image forming unit includes an image carrier that includes a photoconductor layer, a charging device that charges a surface of the image carrier, an exposure device that forms a latent image based on a difference in electrostatic potential by irradiating the charged image carrier with image light, a developing device that forms a toner image by transferring toner to the latent image, and a transfer device that transfers the toner image onto the recording medium directly or through an intermediate transfer body, wherein the exposure device irradiates the image carrier with the image light in an area such that a width of the toner image at a rear end in the transporting direction of the recording medium is larger than a width of the toner image at a front end in the transporting direction of the recording medium when the toner image is transferred onto the recording medium.

3. The image forming apparatus according to claim 1, wherein the difference between the width of the image in the direction substantially orthogonal to the transporting direction of the recording medium and a width of the recording medium in the direction substantially orthogonal to the transporting direction of the recording medium is set so as to decrease as a basis weight of the recording medium increases.

4. The image forming apparatus according to claim 2, wherein the difference between the width of the image in the direction substantially orthogonal to the transporting direction of the recording medium and a width of the recording medium in the direction substantially orthogonal to the transporting direction of the recording medium is set so as to decrease as a basis weight of the recording medium increases.

5. The image forming apparatus according to claim 1, wherein the difference between the width of the image in the direction substantially orthogonal to the transporting direction of the recording medium and a width of the recording medium in the direction substantially orthogonal to the transporting direction of the recording medium is changed in accordance with a dimension of the recording medium in a width direction.

6. The image forming apparatus according to claim 2, wherein the difference between the width of the image in the direction substantially orthogonal to the transporting direction of the recording medium and a width of the recording medium in the direction substantially orthogonal to the transporting direction of the recording medium is changed in accordance with a dimension of the recording medium in a width direction.

7. The image forming apparatus according to claim 3, wherein the difference between the width of the image in the direction substantially orthogonal to the transporting direction of the recording medium and a width of the recording medium in the direction substantially orthogonal to the transporting direction of the recording medium is changed in accordance with a dimension of the recording medium in a width direction.

8. The image forming apparatus according to claim 4, wherein the difference between the width of the image in the direction substantially orthogonal to the transporting direction of the recording medium and a width of the recording medium in the direction substantially orthogonal to the transporting direction of the recording medium is changed in accordance with a dimension of the recording medium in a width direction.

* * * * *